United States Patent [19]

Hanson

[11] 4,099,612

[45] Jul. 11, 1978

[54] DISPLAY CARTON FOR LAMP FIXTURES

[75] Inventor: Wallace E. Hanson, Hampden, Mass.

[73] Assignee: Champion International Corporation, Stamford, Conn.

[21] Appl. No.: 691,377

[22] Filed: Jun. 1, 1976

[51] Int. Cl.[2] ..... B65D 5/32

[52] U.S. Cl. ..... 206/45.19; 206/45.27; 206/45.31; 206/418; 206/588; 229/23 BT

[58] Field of Search ..... 229/23 BT; 206/45.25, 206/45.27, 45.14, 45.15, 45.19, 45.31, 521, 418, 588, 589, 590, 45.34

[56] References Cited

U.S. PATENT DOCUMENTS

| | | | |
|---|---|---|---|
| D. 120,125 | 4/1940 | Korda | 206/45.34 |
| 1,710,543 | 4/1929 | Leo | 206/329 |
| 3,055,495 | 9/1962 | Naimer | 206/521 |
| 3,493,103 | 2/1970 | Cote | 206/45.14 |
| 3,631,970 | 1/1972 | Trauschke | 206/45.14 |
| 3,739,905 | 6/1973 | Ward | 206/521 |
| 3,746,156 | 7/1973 | Austin, Jr. et al. | 206/45.14 |
| 3,951,329 | 4/1976 | Turner | 229/23 BT |
| 3,966,112 | 6/1976 | Gordon | 229/23 BT |
| 3,973,356 | 8/1976 | Schacht | 229/23 BT |

*Primary Examiner*—William Price
*Assistant Examiner*—Joseph M. Moy
*Attorney, Agent, or Firm*—Evelyn M. Sommer

[57] ABSTRACT

A display carton for accommodating various sizes of glass lamp fixtures, of variable widths as well as heights, comprises basically a three piece construction, including a first upper member having a base and a peripheral upstanding wall portion, and a lower member also including a base and an upstanding wall portion. The upper and lower members are slidably assembled so as to form the upper and lower portions of the carton, with each member respectfully supporting the opposite ends of the glass lamp fixture. The lower member includes an aperture for receiving the base end of the glass lamp fixture, and in order to accommodate different size diameters of lamp fixtures, an additional card having an aperture may be provided and temporarily secured to the lower member, with one end of the lamp fixture passing through the aperture in the card. Because of the sliding arrangement between the two members, lamp fixtures of variable height may be readily accommodated.

9 Claims, 7 Drawing Figures

DISPLAY CARTON FOR LAMP FIXTURES

The subject invention relates generally to paperboard containers, and more particularly to a novel display package or container capable of being formed from two paperboard blanks, with the paperboard blanks forming two conforming base portions that are adjustable so as to accomodate different size items, such as glass lamp fixtures.

Decorative replacement glass fixtures for use in various types of lamps are of many different sizes and shapes. Fundamentally, each lamp fixture includes a base portion having an annular flange which is accomodated within the electric socket means, while the opposite end of the glass fixture may be of several configurations, in accordance with the specific design of the glass lamp fixture. In addition, the lengths of the glass fixtures are varied in accordance with the specific design of the fixtures. Heretofore, it has been customary to custom design each display carton for the specific configuration of the lamp fixture. At present it is known to provide seven different box structures to hold 42 varieties of lamp fixtures of different sizes, shapes and widths, some of which are very delicate while others are of sturdy construction. Another known prior art box for lamp fixtures is a large oversized container of corrugated paper which is completely closed thereby affording no visibility of the lamp globe.

It is an object of the subject invention to provide a universal display carton for glass lamp fixtures which may be adjusted to accomodate lamp fixtures of different lengths, as well as lamp fixtures having different annular base portions.

The subject invention basically comprises a three-part paperboard blank, the first blank of which is formed to define a lower base portion having upstanding wall portions defining a first peripheral wall, and with the base portion having an aperture for receiving one end of the glass lamp fixture. The upper member is generally similar in configuration to the first member, but the size of its base portion is slightly different than the size of the first base portion, whereby the first and second base portions may be slidably received together in coextensive relationship, so that the length of the resulting carton may be adjusted to accomodate different size lamp fixtures. The upper member also includes an interior cushioning surface for accomodating the opposite end of the glass lamp fixture. If desired, a third paperboard blank may be provided, which comprises a sheet having an aperture which is specifically designed to accomodate the end of the specific lamp fixture to be received within the display carton. Generally the aperture in the lower base member is large enough to accomodate the largest lamp fixture design to be received within the display carton, and when a smaller lamp fixture is to be mounted in the carton, the third paperboard blank would be provided, with the third paperboard blank having an aperture corresponding in size to the end of the smaller lamp fixture.

In a preferred embodiment, the configuration of the base portions of the display carton are generally hexagonal, and the respective upstanding walls of the first and second base members are configured so as to have one shorter wall, and two inclined walls, whereby when the two base portions are assembled together, an opening is provided in order to enable the consumer to see the entire glass lamp fixture. In addition, portions of the upstanding walls of the respective base portions are folded inwardly so as to form a cushioned paperboard structure for supporting the glass lamp fixtures in order to absorb shocks, and other mishandling, during shipping.

Accordingly, there is provided a new and improved display carton which is formed of paperboard blanks, and is particularly suited for accomodating different sizes of articles to be displayed, such as glass lamp fixtures. By virtue of the construction of the subject display carton, lamp fixtures of variable height, as well as of variable socket diameter may be accomodated utilizing a single display carton made according to the subject invention. The subject display carton is constructed so as to both attractively display the lamp fixture, and protect the lamp fixture during shipping.

Other objects and advantages of the invention will become apparent from a reading of the following detailed description taken in conjunction with the drawings in which.

Figure 1:
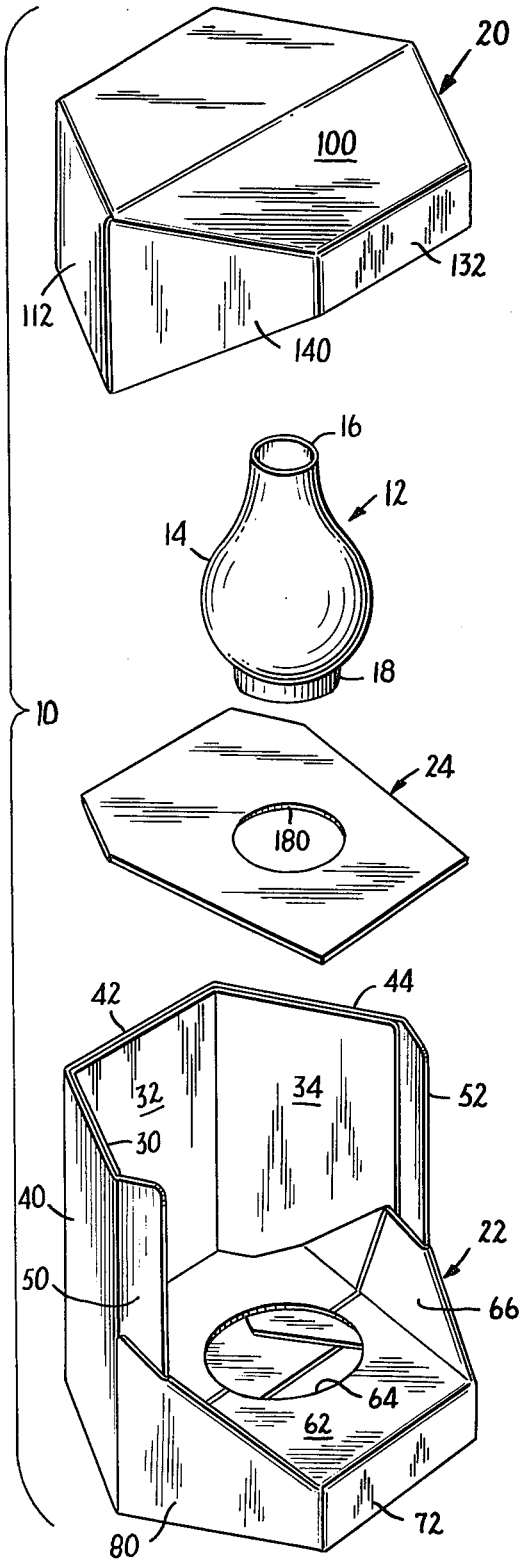
FIG. 1 is an exploded perspective view of the subject display carton, and including a glass lamp fixture.

Referring to FIG. 1, the display carton of the subject invention is designated by the numeral 10 and is adapted to accomodate various sizes of lamp fixtures 12. Each lamp fixture 12 is of fragile construction, usually glass, and basically includes a bulbous area 14, and upper annular edge 16, and a lower annular base portion 18 that is received within the electrical housing of the lamp. The subject display carton 10 is uniquely constructed for accomodating lamp fixtures 12 having base portions 18 of different diameters, as well as fixtures of different total lengths extending between the base portion 18 and the annular edge 16.

The display carton 10 basically comprises an upper member 20, a lower member 22, and for certain applications, an apertured blank portion 24. The upper member 20 is slidably received within the upstanding wall portion of the lower member 22 in coextensive relationship so as to provide a display carton which may be adjusted in total height for different lengths of lamp fixtures 12. As indicated in FIG. 1, the lower member 22 includes an aperture 64, and in those instances wherein the diameter of the base portion 18 of the lamp fixture is less than the diameter of the aperture 64, an apertured blank 24 would be provided, with the aperture 180 in the blank 24 corresponding in diameter to the diameter of the annular base portion 18. The apertured blank 24 may be releaseably connected or bonded to the inside panel portion 62 of the lower member 22.

In order to more fully understand the construction and features of the subject display carton, reference will now be made to FIGS. 5, 6, and 7 which illustrate in plan the carton blanks forming the lower member 22, the upper member 20, and the apertured blank 24, respectively.

Figure 3:
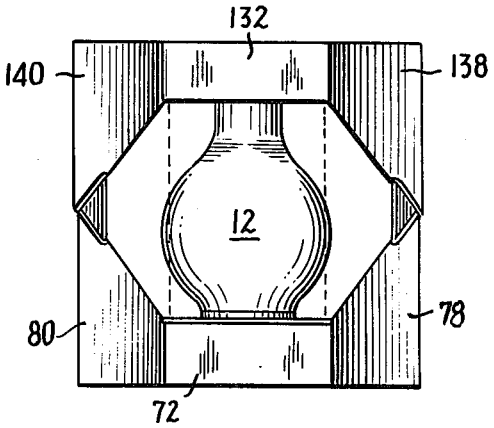
FIG. 3 is a front view of the display carton of FIG. 2.
Figure 4:
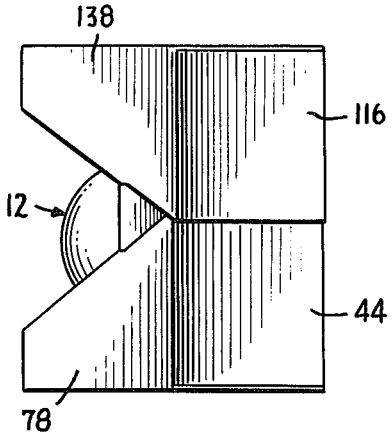
FIG. 4 is a side view of the display carton of FIG. 2.
Figure 5:
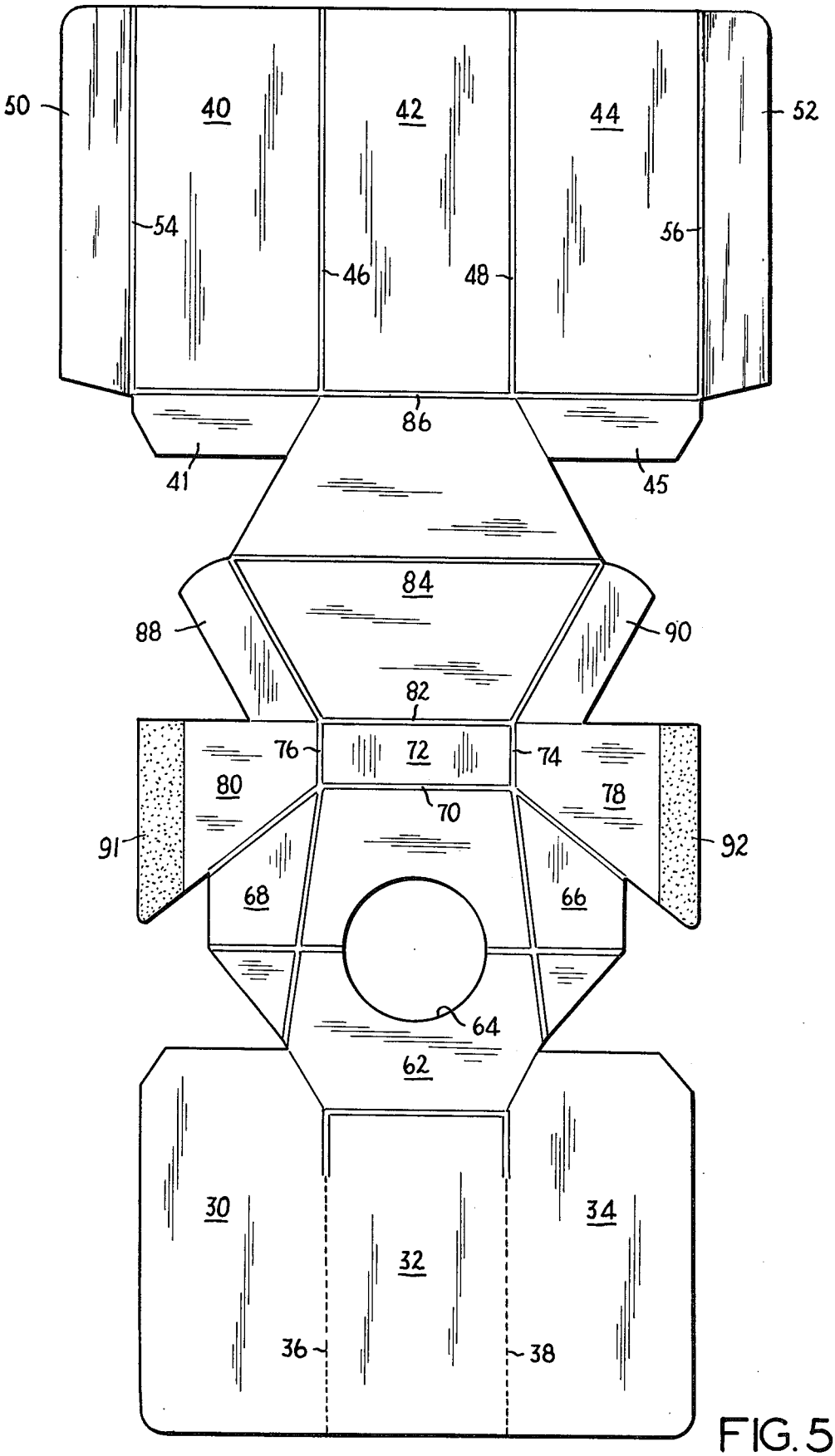
FIG. 5 is a plan view of the paperboard blank forming the lower base member of the carton of the subject invention.

Referring to FIG. 5, the lower member 22 is formed of a single sheet or blank of paperboard material that is configured whereby it may be folded, and held together by glue on panels 91 and 92 to define a base having inner and outer surface portions as well as an upstanding wall portion of double thickness, which extends about more than half of the periphery of the base portion. (see FIG. 1) More particularly, the paperboard blank includes three panels designated by numerals 30, 32 and 34 that are interconnected by fold lines 36 and 38, with said panels 30, 32 and 34 defining the inside upstanding wall portion of the lower member 22. The external upstanding wall portion is defined by three panels 40, 42 and 44 interconnected by fold lines 46 and 48, and furthermore including partial wall panels 50 and 52 respectively connected by fold lines 54 and 56 to panels 40 and 44. Flap portions 41 and 45 depend from panels 40 and 44. The interior base portion of the lower member 22 is defined by panel 62 which is of generally hexagonal configuration, and includes the central aperture 64. Flap portions 66 and 68 form portions of the panel 62, and in the final configuration of the lower member 22 are generally inclined, and bear against the interior upstanding wall panels 30, 32 and 34, as shown in FIG. 1. The front panel 72 of the lower member 22 is connected to the panel portion 62 by fold line 70, and side panel portions 78 and 80 are connected to said front panel along fold lines 74 and 76 respectively. Panel 91 is connected to panel 78 while panel 92 is connected to panel 78. In turn, the front panel 72 is connected along fold line 82 to the external base 84 of the lower member. The external base 84 is generally of an hexagonal configuration, and is connected to the central exterior panel 42 along fold line 86. Internal flaps 88 and 90 are connected to the external base 84. In the folded configuration of the lower member 22, as shown in FIGS. 1 through 4, it is noted that the upstanding wall panel 30, 32 and 34 lie within and conform to the external upstanding wall panels 40, 42 and 44 and the partial wall panels 50 and 52. The flaps 41 and 45 are folded inwardly so as to be intermediate the external base panel 84 and the interior base panel 62. The front panel 72, in cooperation with the side panel portions 78 and 80, as well as the inclined flap portions 66 and 68 of the interior base portion cooperate to form an inclined interior base portion of the lower member, thereby adding to the aesthetics of the display carton. In addition, it is noted that when fully assembled the panel portion 62 is spaced from the external base 84, thereby providing a construction for engaging the annular base portion 18 of the lamp fixture 12. By virture of the double wall construction of the upstanding peripheral wall, as well as the one piece construction of the lower member 22, the paperboard blank illustrated in FIG. 5 may be folded so as to effectively interlock the panel members, with side panels 91 and 92 being adhesively bonded to partial panels 50 and 52.

Figure 2:
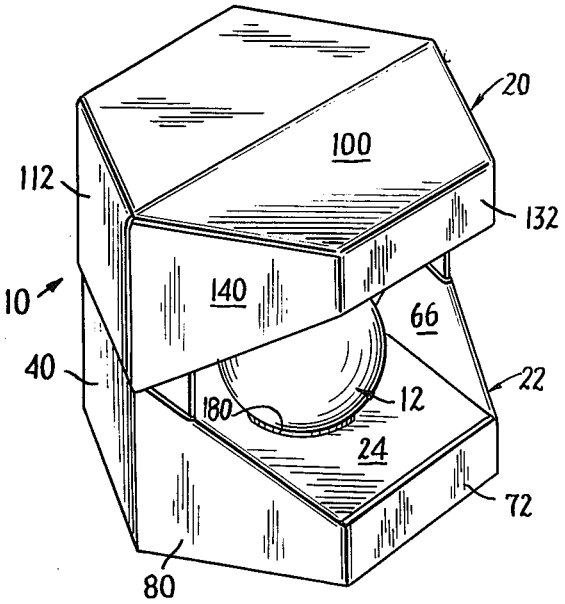
FIG. 2 is a perspective view of the subject display carton when fully assembled and mounting therein a glass lamp fixture.
Figure 6:
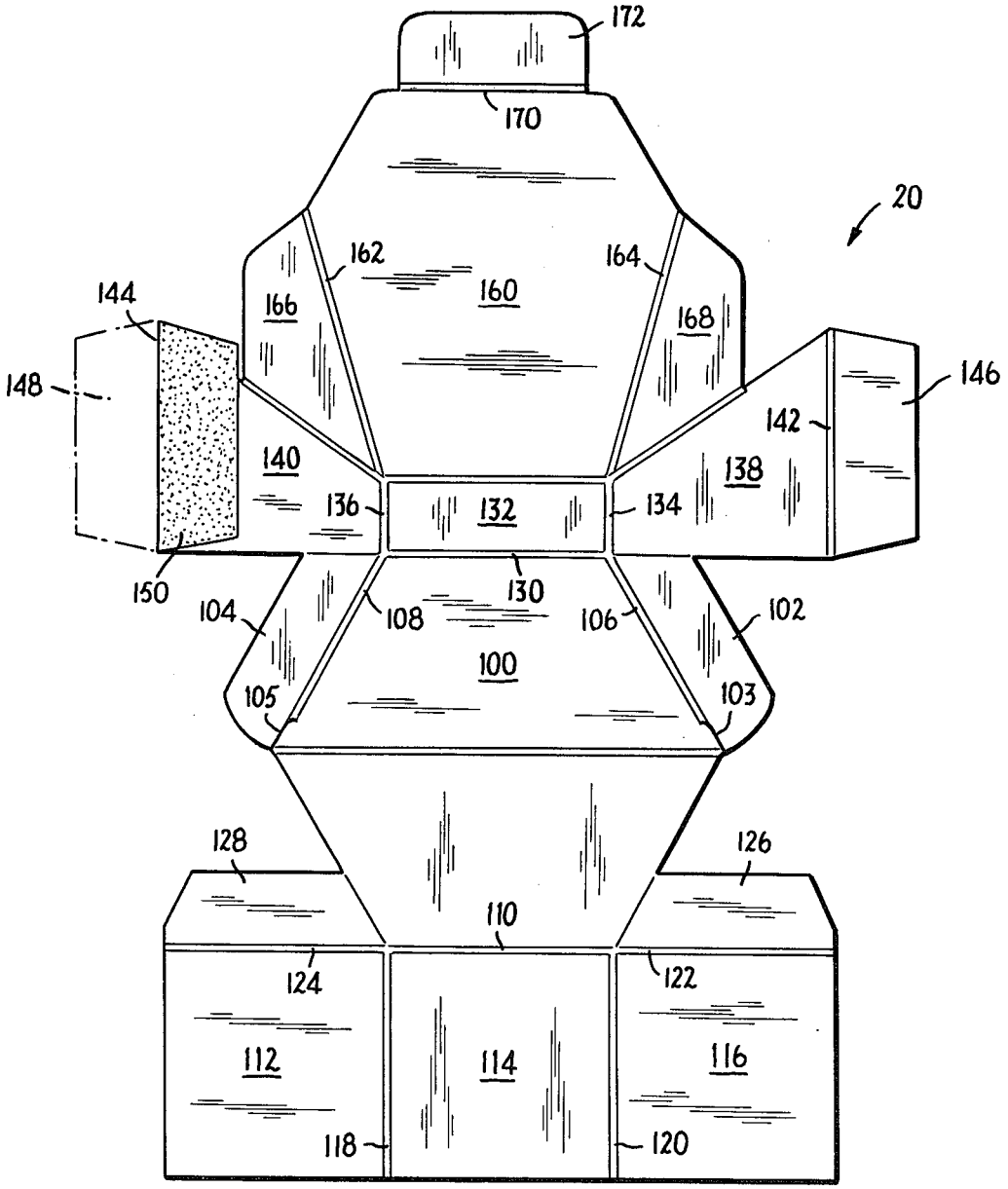
FIG. 6 is a plan view of the paperboard blank forming the upper member of the display carton of the subject invention.
Figure 7:
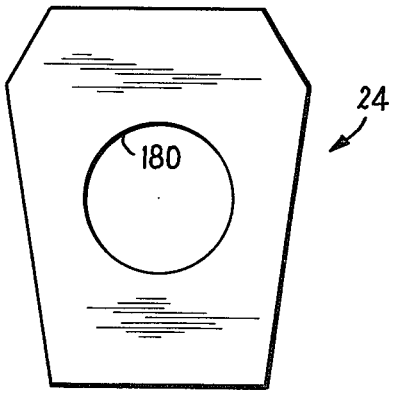
FIG. 7 is a plan view of the paperboard blank forming a third member of the display carton of the subject invention.

Turning now to FIG. 6 which illustrates the paperboard blank for forming the upper member 20, said blank includes an upper surface 100 of generally hexagonal configuration. As illustrated in FIGS. 2 through 4, the upper member is adapted to be slidably received and to be coextensive with the lower member 22, and to effect the relative sliding interengagement of said members, preferably the upper surface 100 is of slightly greater size than the lower base portion 84. Tabs 102 and 104 are connected to the upper surface panel 100 along fold lines 106 and 108, while fold line 110 connects said upper surface panel 100 to panels 112, 114 and 116 which form the peripheral wall of the upper member 20. Fold lines 118 and 120 interconnect the wall panels 112, 114 and 116, and inwardly foldable flaps 126 and 128 are respectively connected to wall panels 116 and 112 via fold lines 122 and 124.

At the opposed edge 130 to the fold line 110, front panel 132 is provided, and is interconnected to front side panels 138 and 140 along fold lines 134 and 136 respectively. Extending from the extremities of the front side panels 138 and 140 along fold lines 142 and 144 are glue tabs 146 and 148 to which is applied an adhesive material 150. As shown in FIG. 6, the adhesive material is applied to the underside of the paperboard blank forming the upper member 20 to the side illustrated. The inside surface of the generally hexagonal contoured upper member 20 is formed by panel 160 which is connected by fold lines 162 and 164 to incline flaps 166 and 168 respectively. An inwardly foldable tab 172 is also connected to the panel 160 along fold line 170. Tabs 102 and 104 include notched cut-outs 103 and 105 respectively whereby, in the assembled position of the upper member 20, the inwardly foldable tabs 126 and 128 are slipped through and engage said notched cut-outs. At that time, the inside surface panel 160 is disposed within the confines of the upper member 20, with the flaps 166 and 168 being inclined. The upstanding peripheral wall portion of the upper member is defined by the panels 112, 114, 116, with panels 112 and 116 being respectively secured to the glue tabs 148 and 146. Accordingly, the front portion of the upper member 20, as illustrated in FIGS. 1 through 4 is defined by the front panel 132, and the front side panels 138 and 140. In the assembled position, the inside surface 160 is spaced from the upper surface 100 thereby providing an effective cushioning construction in case of vibration or shock applied to the carton when it is being transported with a lamp fixture 12 therein.

As indicated above, for certain applications in which the aperture 64 in the lower member 62 is greater than the diameter of the annular base portion 18 of the lamp fixture 12, an apertured blank 24 may be provided, including a central aperture 180. Apertured blank 24 may be bonded to the inner panel portion 62 of lower member 22, or alternatively may be merely placed on the lower member, and as the annular base portion 18 of the fixture is passed through the aperture 180, the frictional engagement of the members will hold blank 24 in place.

As shown in FIGS. 2 through 4, because of the specific dimensions of the upper and lower members 20 and 22, the display carton 10 of the subject invention is assembled by the interengagement of said members in coextensive relationship, with the upper peripheral wall 112–114–116 overlying the double upwardly extending peripheral wall (30–34 and 40'44) of the lower member 22. In the assembled condition, with a lamp fixture 12 provided in the display carton 10, the upper annular edge 16 bears against the inner planar surface 160 of the upper member 20, and the upper member is pushed down sufficiently into the lower member 22 to frictionally engage and hold in place the lamp fixture 12. Various types of lamp fixtures, of different lengths, may be accomodated in the display carton 10 of the subject invention, and by virtue of the use of an apertured blank 24, lamp fixtures having different base portions 18 may also be accomodated.

While the invention has been described in connection with a preferred embodiment of the display carton, it is to be understood that it is not intended to limit the invention to that embodiment. On the contrary, it is intended to cover all alternatives, modifications and equivalents as may be included within the spirit and scope of the invention as defined by the appended claim. For example, the configuration of the base or top parts of the display carton may be other than hexagonal, as illustrated, such as square, round, etc.

What is claimed is:

1. A display carton formed from two paperboard blanks comprising:

(a) an upper member including a first base portion and upstanding wall portion defining a first peripheral wall, said first base portion including an upper surface and an inside surface spaced from said upper surface and adapted to bear against one end of the item to be mounted in the display carton; and (b) a lower member including a second base portion and upstanding wall portion defining a second peripheral wall, said second base portion including a lower surface and a support surface spaced from said lower surface, said second peripheral wall having a configuration corresponding to said first peripheral portion but of different size, said support surface including an aperture for receiving the opposite end of the item to be mounted in the display carton, said upper and lower members slidably intermeshed with the first and second peripheral wall portions being partially coextensive and providing an open window for the visibility of the item contained therein, and with the first and second base portions forming the opposite ends of the display carton.

2. A display carton formed from two paperboard blanks as in claim 1 further including a third paperboard blank comprising a sheet of smaller size than said first base portion, which set includes a central aperture through which one end of said item is received.

3. A display carton formed from two paperboard blanks as in claim 1 wherein the configuration of said first and second base portions, as well as the configuration of said first and second peripheral walls is generally hexagonal.

4. A display carton formed of two paperboard blanks as in claim 1 wherein said second peripheral wall is of double thickness of paperboard.

5. A display carton formed of two paperboard blanks as in claim 1 wherein said lower member is formed of a single blank of paperboard including:

(a) a first set of three elongated, generally rectangular panels which are foldably connected along fold lines extending parallel to the longitudinal axis of said first set of rectangular panels;

(b) an external base member of generally hexagonal configuration, said external base being foldably connected along one edge thereof to one of said first set of rectangular panels;

(c) a front panel foldably connected to said external base member along an edge thereof opposite said one edge;

(d) an interior base member substantially conforming in configuration to said external base member, and foldably connected to said front panel; said interior base member including said aperture therein; and (e) a second set of elongated generally rectangular panels foldably connected along fold lines extending parallel to the longitudinal axis of said second set of rectangular panels, with one of the latter being foldably connected to said interior base member.

6. A display carton formed to two paperboard blanks as in claim 5 further including side panel portions foldably connected to opposite sides of said front panel.

7. A display carton formed of two paperboard blanks as in claim 11 wherein said upper member is formed of a single blank of paperboard including:

(a) an array of three wall portions including a center portion and two end portions which are foldably interconnected;

(b) an external surface panel foldably connected along one side thereof to the center portion of said array of three wall portions;

(c) a front panel foldably connected to said external surface panel;

(d) an internal surface panel foldably connected to said front panel; and (e) glue tabs foldably connected to said front panel and adapted respectively engage the opposed end portions.

8. A display carton formed of two paperboard blanks as in claim 7 wherein said interior surface panel and said external surface panel are generally hexagonal in configuration.

9. A display carton formed of two paperboard blanks as in claim 7 further including opposed front side panels respectively interconnecting said front panel to said glue tabs.

* * * * *

UNITED STATES PATENT AND TRADEMARK OFFICE

CERTIFICATE OF CORRECTION

PATENT NO. : 4,099,612

DATED : July 11, 1978

INVENTOR(S) : WALLACE E. HANSON

It is certified that error appears in the above-identified patent and that said Letters Patent are hereby corrected as shown below:

In Column 6, Claim 7, line 29, delete "11" and insert in lieu thereof -- 1 --.

Signed and Sealed this

*Twenty-second* Day of *April 1980*

[SEAL]

*Attest:*

SIDNEY A. DIAMOND

*Attesting Officer*

*Commissioner of Patents and Trademarks*